United States Patent [19]

Clarke et al.

[11] 4,281,824

[45] Aug. 4, 1981

[54] HEAT TREATING APPARATUS

[75] Inventors: Beresford N. Clarke; Wilfred G. Shedd, both of Fort Wayne, Ind.

[73] Assignee: Metals, Inc., Fort Wayne, Ind.

[21] Appl. No.: 955,344

[22] Filed: Oct. 27, 1978

[51] Int. Cl.[3] ..... C21D 1/06

[52] U.S. Cl. ..... 266/251; 432/106; 432/118

[58] Field of Search ..... 148/16, 16.5, 16.6, 148/16.7, 20.3; 266/251; 432/26, 106, 112, 118, 128

[56] References Cited

U.S. PATENT DOCUMENTS

| | | | |
|---|---|---|---|
| 627,333 | 6/1899 | Harvey | 432/106 |
| 2,713,480 | 7/1955 | Ruckstahl | 432/128 |
| 3,314,826 | 4/1967 | Garwood et al. | 148/16 |
| 3,982,887 | 9/1976 | Kendziora et al. | 432/128 |
| 4,010,552 | 3/1977 | Peterson | 432/128 |
| 4,049,473 | 9/1977 | Davis et al. | 148/16.6 |
| 4,123,292 | 10/1978 | Gibson | 148/16 |
| 4,154,433 | 5/1979 | Kato | 266/251 |

*Primary Examiner*—L. Dewayne Rutledge
*Assistant Examiner*—John P. Sheehan
*Attorney, Agent, or Firm*—Lundy and Associates

[57] ABSTRACT

An apparatus for metallurgically heat treating workpieces, the apparatus comprises a rotatable retort having an elongated treating chamber. A workpiece conveyor is within the treating chamber whereby the workpieces can be moved from the entrance end to the exit end of the treating chamber. A plurality of partitions within the treating chamber cooperate with the conveyor and treating chamber to divide the treating chamber into a plurality of distinct atmospherically isolated chambers and to allow for the movement of the workpieces into and out of the chambers. A gas distributor is within the treating chamber. The gas distributor is operatively connected to a reactive gas source and has gas outlets in selected ones of the chambers.

21 Claims, 5 Drawing Figures

HEAT TREATING APPARATUS

BACKGROUND OF THE INVENTION

The invention relates to an apparatus for metallurgically heat treating workpieces, and more particularly, to a method and apparatus for surface treating workpieces.

Surface treating (e.g. carburization and carbonitriding) of metal (e.g. steel) workpieces is well-known wherein the composition of the workpieces for a certain depth from the surface (of the workpieces) is altered. This alteration may give the workpieces various properties. An example is when a steel workpiece is carburized, a "case" of increased carbon content is formed at and below the surface so that the workpiece may be hardened upon being quenched.

In the past, the surface treating of metals utilize a chamber into which passes a conduit. A reactive atmosphere is introduced into the chamber through the conduit. For the most part, a gross excess volume of reactive atmosphere is introduced into the chamber so that a complete surface reaction will occur. However, the consequences of introducing an excess of reactive atmosphere sometimes is to cause some components of the reactive atmosphere to precipitate out. Carbon precipitation not only causes the workpieces to become "dirty", but also contaminates and shortens the operating life of the chamber. Further, the introduction of a gross excess volume of reactive atmosphere is wasteful.

Thus, it would be highly desirable to provide an apparatus for metallurgically surface treating workpieces which would only require a volume of the reactive atmosphere that approximates the theoretical volume required for the reaction. It would also be highly desirable to provide an apparatus for metallurgically surface treating workpieces which would not cause the workpieces to become "dirty". It would also be highly desirable to provide an apparatus for metallurgically surface treating workpieces which is not wasteful of the reactive atmosphere and which does not shorten the life of the chamber.

Using presently existing methods and apparatus, the reactive atmosphere is not forcefully introduced into the chamber so as to facilitate the exposure of the workpieces to the reactive atmosphere. Only the mechanical jostling of the workpieces exposes them to the reactive atmosphere within the chamber. Few attempts have been made to better expose the workpieces to the reactive atmosphere. Thus, it would be highly desirable to provide an apparatus for metallurgically surface treating workpieces which includes means for facilitating the exposure of the workpieces to the reactive atmosphere other than mechanical jostling. It would also be highly desirable to provide an apparatus for metallurgically surface treating workpieces that includes the forceful distribution of the reactive atmosphere directly into the workpieces contained within the chamber.

Using existing methods and apparatus, the reactive atmosphere is allowed to freely flow through and out of the chamber. No attempt has been made to provide a means to impede this free flow. By dividing the treating chamber into a plurality of atmospherically isolated reaction chambers, less reaction gas can be used, and better control of the concentration of reaction gas can be achieved. Thus, it would be highly desirable to provide an apparatus for metallurgically surface treating workpieces that divides the treating chamber into a plurality of atmospherically isolated reaction chambers and prevents the free flow of reactive atmosphere through the chamber.

SUMMARY OF THE INVENTION

Therefore, it is an object of the invention to provide a new and improved apparatus for metallurgically heat treating workpieces.

It is an object of the invention to provide a new and improved apparatus for metallurgically heat treating workpieces which allows for the introduction of a selected volume of reactive atmosphere into the reaction chamber wherein the volume approximates the theoretical volume required for the reaction.

It is an object of the invention to provide a new and improved apparatus for metallurgically heat treating workpieces which does not require the introduction of a gross excess volume of reactive atmosphere into the reaction chamber.

It is an object of the invention to provide a new and improved apparatus for metallurgically heat treating workpieces that is not wasteful of the reactive atmosphere.

It is another object of the invention to provide a new and improved apparatus for metallurgically heat treating workpieces in which the exposure of the workpieces to the reactive atmosphere is facilitated by means other than mechanical jostling.

It is another object of the invention to provide a new and improved apparatus for metallurgically heat treating workpieces that includes the forceful introduction of the reactive atmosphere directly into the workpieces contained within the chamber.

It is another object of the invention to provide a new and improved apparatus for metallurgical heat treating workpieces in which the treating chamber is divided into a plurality of atmospherically isolated reaction chambers.

It is another object of the invention to provide a new and improved apparatus for metallurgical heat treating workpieces that includes the introduction of a reactive atmosphere into relatively segregated reaction chambers.

Finally, it is another object of the invention to provide a new and improved apparatus for metallurgical heat treating workpieces that includes the maintenance of the reactive atmosphere within atmospherically segregated reaction chambers.

In the broader aspects of the invention, the apparatus comprises a rotatable retort having an elongated treating chamber. The workpiece conveyor is within the treating chamber whereby the workpiece can be moved from the entrance end to the exit end of the treating chamber. A plurality of partitions within the treating chamber cooperate with the conveyor and treating chamber to divide the treating chamber into a plurality of distinct atmospherically isolated chambers and to allow for the movement of the workpieces into and out of the chambers. A gas distributor is within the treating chamber. The gas distributor is operatively connected to a reactive gas source and has gas outlets in selected ones of the chambers.

The apparatus comprises an elongated treating chamber having an entrance and exit. A workpiece conveyor is within treating chamber whereby the workpieces can be moved from the entrance to the exit. A plurality of partitions within the treating chamber cooperate with the conveyor and treating chamber to allow for the movement of the workpieces and to divide the treating chamber into a plurality of essentially atmospherically isolated reaction chambers. A reactive gas distributor is within the treating chamber. The gas distributor is operatively connected to a reactive gas source and has gas outlets in selected ones of the reaction chambers.

BRIEF DESCRIPTION OF THE DRAWINGS

The above mentioned and other features and objects of this invention and the manner of attaining them will become more apparent and the invention itself will be best understood by reference to the following description of the invention taken in conjunction with the accompanying drawings wherein.

DETAILED DESCRIPTION OF A SPECIFIC EMBODIMENT APPARATUS

Figure 1:
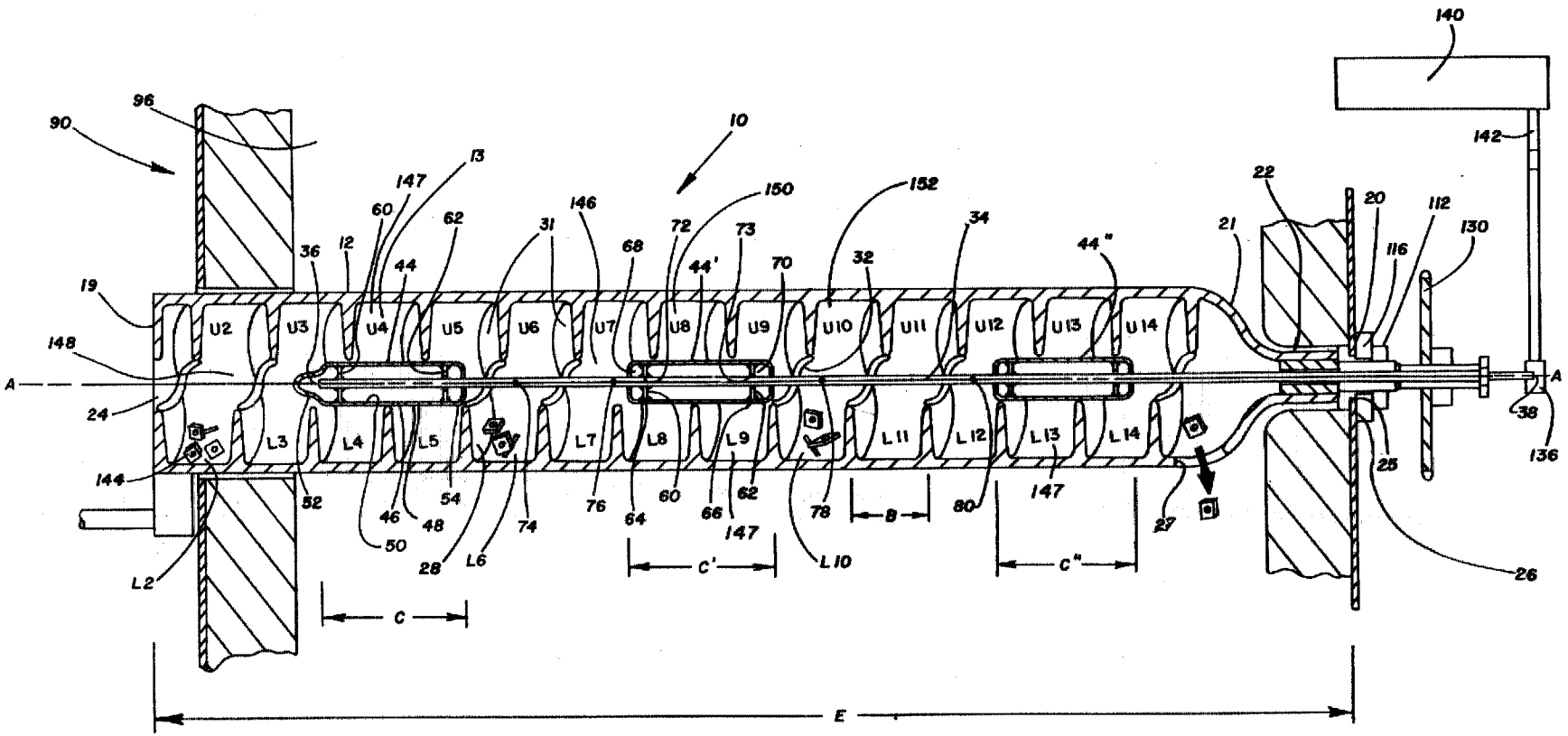
FIG. 1 is a cross-sectional view of the apparatus of the specific embodiment taken longitudinally thereof.

Referring to FIG. 1, there is illustrated a heat treating apparatus 10 of the invention. The heat treating apparatus 10 includes a cylindrical retort 12 having an elongated treating chamber 13 and opposite ends 19 and 20. A portion 21 of the retort 12 adjacent end 20 thereof converges toward the longitudinal axis A—A of the retort 12 so as to form a neck 22. An opening 24 is located in end 19 of retort 12, and the retort neck 22 extends through the opening 25 in the furnace casing 26. Work pieces 144 may be introduced into the treating chamber 13 through opening 24. A work piece exit opening 27 is contained in the converging portion 21 of retort 12.

A helical member 28 comprised of a plurality of helical turns 31 (having a pitch of length B) is contained within the treating chamber 13 by being affixed to the interior wall of the retort 12. The workpiece conveyor or helical member 28 extends the entire length of the treating chamber 13 and includes a pathway 32 therethrough which is coaxial with the axis A—A of the retort 12.

A gas distributor or distribution pipe 34 has one closed end 36 and one open end 38. A plurality of pipe supports 44 are attached to the distribution pipe 34 at selected positions thereon. Each pipe support 44 is structurally similar so that a description of one will suffice for all.

Each pipe support or partition 44 includes a cylindrical housing 46 which has exterior and interior surfaces 48 and 50, respectively, and opposite ends 52 and 54. The cylindrical housing 46 of the specific embodiment illustrated is of a length which is approximately two times the pitch B of the helical turns 31. The portions of the cylindrical housing 46 adjacent the opposite ends 52 and 54 thereof are inwardly bent.

A pair of gas impedance discs 60 and 62 are located within the cylindrical housing 46 and adjacent the opposite ends 52 and 54 thereof, respectively. The gas impedance discs 60 and 62 have circumferential edge surfaces 64 and 66, respectively, as well as apertures 68 and 70, respectively, that each have an aperture circumferential edge surface 72 and 73, respectively. The gas impedance discs 60 and 62 are affixed (as by welding) to the interior surface 50 of the cylindrical housing 46 at the circumferential edge surfaces 64 and 66 thereof, respectively. The one impedance disc 60 is affixed (as by welding) to the distribution pipe 34 at the circumferential edge surface 72 of aperture 68 thereof, and the other impedance disc 62 is unattached to the distribution pipe 34 and free to move relative thereto.

Figure 2:
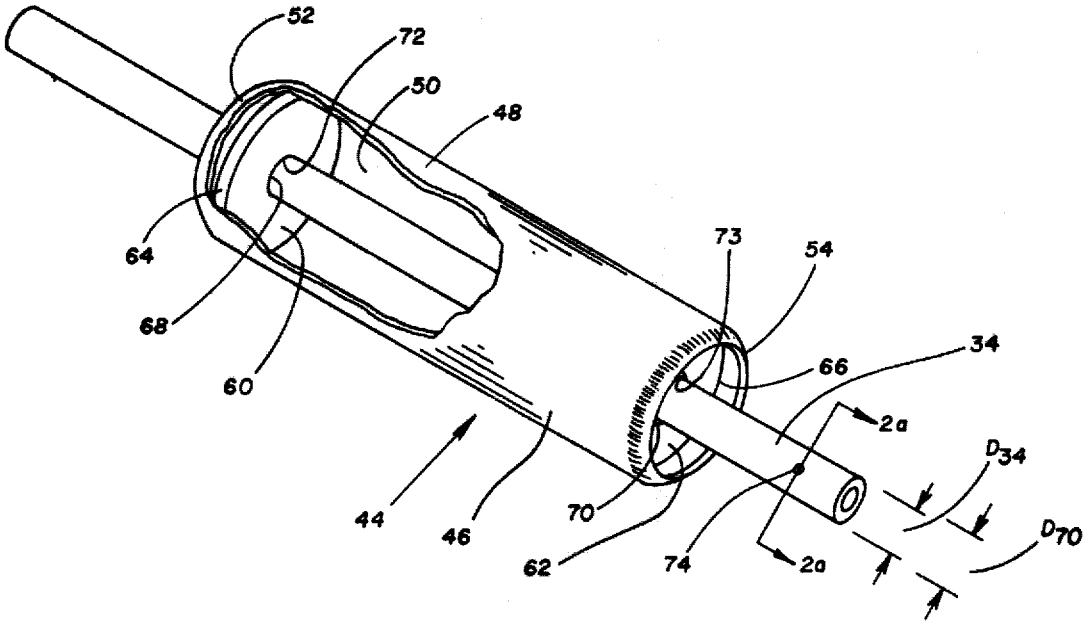
FIG. 2 is a perspective view of a pipe support of the apparatus of the specific embodiment with a portion of the cylindrical housing removed.
Figure 2A:
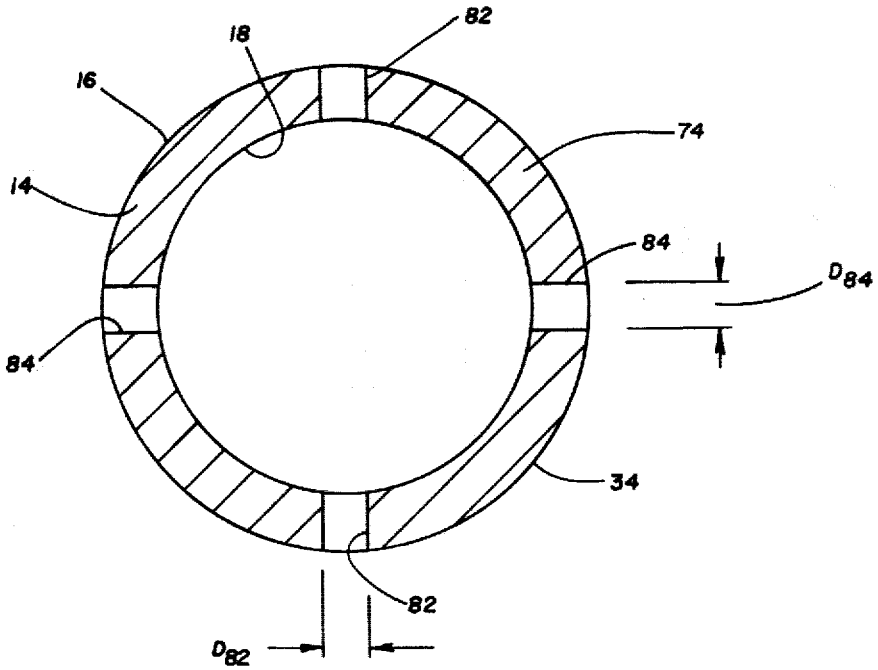
FIG. 2*a* is a cross-sectional view of an orifice arrangement of the apparatus of the specific embodiment along section line 2*a*—2*a*.
Figure 3:
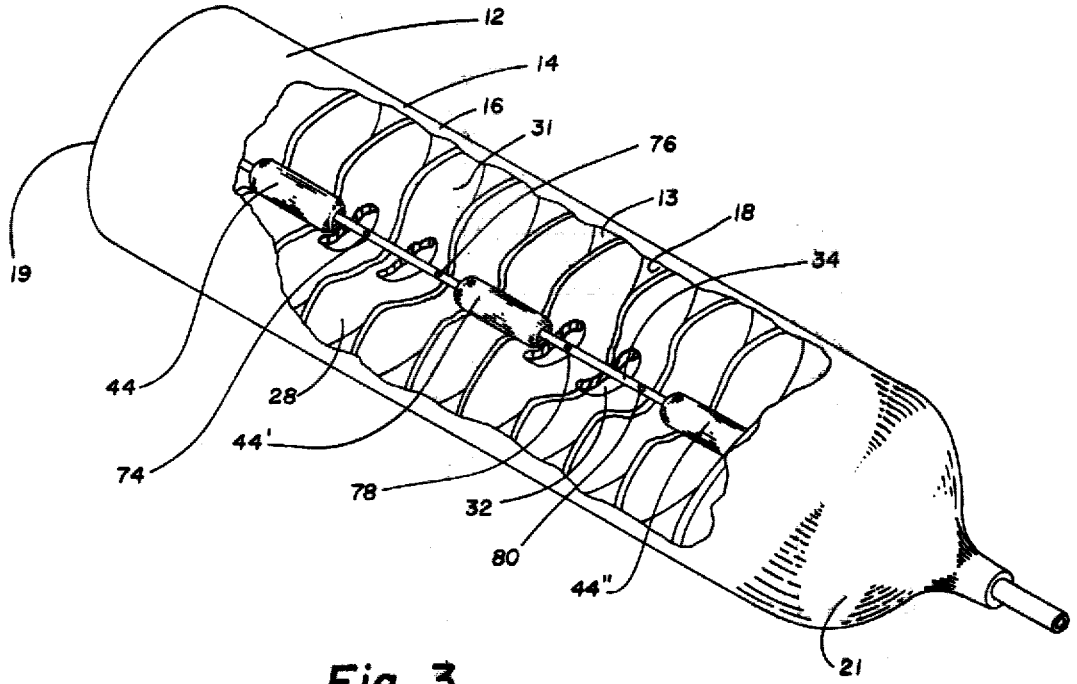
FIG. 3 is a perspective view of the apparatus of the specific embodiment with a portion of the wall removed.
Figure 4:
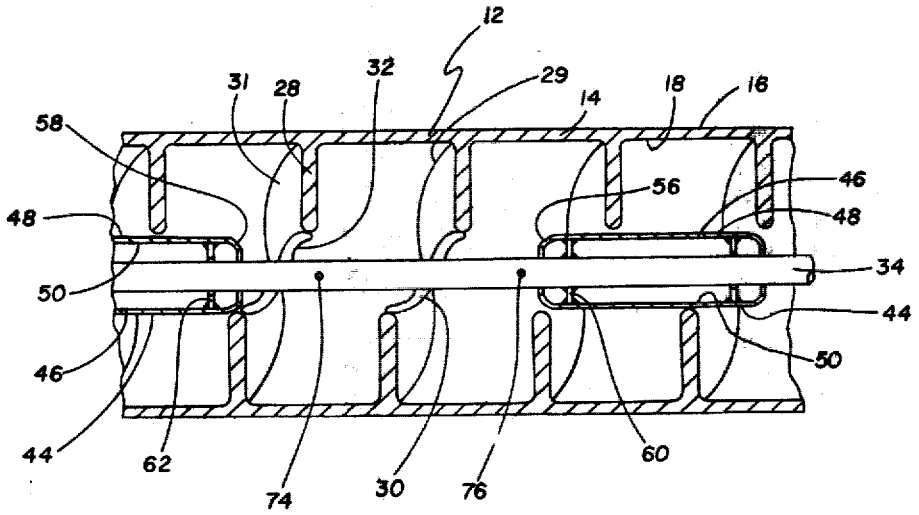
FIG. 4 is a cross-sectional view of a reaction chamber similar to FIG. 1.

First and second gas outlets or orifice arrangements 74 and 76, respectively, are located between the two consecutive pipe supports 44 closest to the one end 36 of the distribution pipe 34. Third and fourth gas outlets or orifice arrangements 78 and 80, respectively, are located between the two consecutive pipe supports 44 closest to the other end 38 of the distribution pipe 34. In a specific embodiment, each orifice arrangement 74, 76, 78, 80 is structurally similar, and includes two pairs of opposite apertures or orifices 82, 84 positioned at 90° apart along the circumference of the distribution pipe 34 as shown in FIG. 2A.

The distribution pipe 34 is contained within the retort 12. The pipe supports 44 rest on the helical turns 31 so that the distribution pipe 34 is oriented whereby its axis is generally coaxial with the longitudinal axis A—A of the retort 12 as well as coaxial with the longitudinal axis of the helical member 28 and the treating chamber 13.

The aperture 70 of the other impedance disc 62 is of a greater diameter than the outside diameter of the distribution pipe 34. This results in some "play" between the other impedance disc 62 and the distribution pipe 34. The diameter of the cylindrical housing 46 is less than that of the helical member pathway 32. This too results in "play" between the helical member 28 and the cylindrical housing 46.

In a furnace 90 having a heating chamber 96 in which the retort 12 is rotatably attached by a conventional means, as illustrated in FIG. 1, the other end 38 of the distribution pipe 34 is connected to a rotating joint 136 which is in communication with reactive atmosphere sources 140 via a conduit 142. The conventional rotatable attachment means includes a bearing 112, a bearing mounting plate 116 and a drive sprocket 130.

Orifice arrangements 74, 76, 78, and 80 and distribution pipe 34 are sized in relation to the pressure of atmosphere source 140 so as to maintain the atmosphere within distribution pipe 34 and orifice arrangements 74, 76, 78, 80 at a velocity higher than and at a temperature lower than critical minimum velocity and a critical maximum temperature, respectively. The pressure and velocity and temperature of the atmosphere are all interrelated and can be expressed mathematically by the well known universal gas law equation. The critical maximum temperature of the atmosphere is that at which the gases become reactive or particulate material, such as free carbon, is deposited from the atmosphere. The critical minimum velocity of the atmosphere is that of which the atmosphere has sufficient "dwell" time within retort 12 to be heated to temperatures equal to or in excess of the critical maximum atmosphere temperature prior to it being jetted from orifice arrangements 74, 76, 78, 80. These critical temperatures and velocities will vary as the surface heating methods used with the retort 12 vary inasmuch as different methods use different atmospheres, retort temperatures, work pieces and retort speeds. In a specific embodiment, distribution pipe 34 and orifice arrangements 74, 76, 78, 80 are sized such that the atmosphere velocity is maintained several times in excess of the critical minimum velocity of each surface treating method to be used with the retort 12.

STRUCTURAL RELATIONSHIPS DURING ROTATION

During the operation of the heat treating apparatus 10, the distribution pipe 34 rotates along with the retort 12. Generally, the distribution pipe 34 will flex in opposite directions, or arc, as it rotates which causes fatigue stresses to be exerted on the distribution pipe 34. The combination of these fatigue stresses and the temperature within the treating chamber 13 facilitates the premature failure of the distribution pipe 34. Thus, it is especially important to provide structure that reduces arcing and consequently prolongs the operational life of the distribution pipe 34 and associated structure.

The trio of pipe supports 44 positioned along the length of the distribution pipe 34 acts to minimize the arcing of the distribution pipe 34 as well as support the distribution pipe 34 within the retort 12. In particular, the pipe supports 44 and the distribution pipe 34 interact at two locations: (1) the point where they are welded together, and (2) the point where the distribution pipe 34 passes through the other impedance disc 62. Fatigue stresses are exerted on the weld between the distribution pipe 34 and the one gas impedance disc 60 when the distribution pipe 34 arcs; however, the aperture 70 acts to damp this arcing due to the "play" between the aperture 70 and the distribution pipe 34. Also, the free passage of the distribution pipe 34 through aperture 70 allows the distribution pipe 34 to freely expand and contract.

Also, the pipe supports 44 are of a sufficiently short length so as to minimize a rotational fatigue stresses exerted thereon. Further, the play between the pipe supports 44 and the helical member 28 acts to damp the arcing of the pipe support 44. Thus, fatigue stresses exerted on the pipe supports 44 are minimized. Because the pipe supports 44 experience minimal arcing, foreign stresses which develop in the welds between the pair of gas impedance discs 60, 62 and their respective pipe supports 44 are lessened.

OPERATION OF THE APPARATUS

In a typical run, the workpieces 144 are stacked so as to have a very high density, especially when the workpieces 144 are small (e.g. nuts, bolts, screws, washers and the like). In a surface treating operation, it is critical that the reactive atmosphere contact the surface of such workpieces 144. Applicant's invention provides a jet of reactive atmosphere which penetrates the stacked workpieces 144 and contacts the workpiece 144 surfaces. Even though the workpieces 144 are jostled to some degree by the operation of the helical turns 31, such jostling alone does not allow for sufficient workpiece 144 surface exposure. Thus, it is essential that the reactive atmosphere be propelled at a sufficient velocity so as to penetrate the stacked workpieces 144.

The reactive atmosphere is jetted into the stacked workpieces 144 through the orifice arrangements 74, 76, 78, 80. Regardless of the position of the distribution pipe 34, at least one orifice 82, 84 is aimed in the general direction of the stacked workpieces 144.

The pipe supports including the pair of gas impedance discs 60, 62 thereof impede the flow of reactive atmosphere through the helical member pathway 32, and together with the helical turns 31, the pipe supports 44 and the treating chamber wall form an essentially atmospherically isolated "reaction chamber". Most all of the reactive atmosphere jetted into a "reaction chamber" is maintained therein. Because the volume of reactive atmosphere contained within a "reaction chamber" is selected and can be controlled, the volume of reactive atmosphere closely approaches the theoretical volume required for the reaction.

The heat-up portion 148 of the treating chamber 13 comprises the helical turns 31 designated $U_2$, $U_3$, $U_4$, $L_2$, $L_3$, $L_4$ and $L_5$. While in the heat-up portion 148, the workpieces 144 are brought to a specified temperature. The number of helical turns 31 contained in the heat-up portion 148 and the speed of rotation of the retort 12 dictate the time the workpieces 144 spend in the heat-up portion 148 and their temperature when they reach the first reaction chamber 146. While in the heat-up portion 148 workpieces 144 are exposed to relatively small volumes of reactive atmosphere.

The first reaction chamber 146 comprises the helical turns 31 designated $U_5$, $U_6$, $U_7$, $L_6$ and $L_7$. The workpieces 144 encounter their first significant exposure to the reactive atmosphere in the first reaction chamber 146. The volume composition and temperature of reactive atmosphere introduced into the first reaction chamber 146 can all be controlled.

The workpieces 144 exit the first reaction chamber 146 into a relief portion 150 which comprises the helical turns 31 designated $U_8$, $L_8$ and $L_9$. The workpieces 144 exit the relief portion 150 into the second reaction chamber 152.

The volume of the second reaction chamber 152 comprises the helical turns 31 designated $U_9$, $U_{10}$, $U_{11}$, $U_{12}$, $L_{10}$, $L_{11}$ and $L_{12}$. The workpieces 144 encounter their second significant exposure to the reactive atmosphere while in the second reaction chamber 152. The volume composition and temperature of reactive atmosphere introduced into the second reaction chamber 152 can also be controlled while in the apparatus illustrated in the drawings, these parameters of the reactive atmosphere in the first and second chambers 146, 152 are related, in other specific embodiments, separate, coaxial distribution pipes 34 can be used so as to provide each reaction chamber with total control over these parameters.

The workpieces 144 pass from the second reaction chamber 152 into the exit portion 154 of the treating chamber which is comprised of the helical turns 31 designated $L_{13}$, $U_{13}$, $L_{14}$ and $U_{14}$. The workpieces 144 are exposed to minimal volumes of the reactive atmosphere when within the exit portion 152 of the treating chamber 13. The workpieces 144 exit and retort 12 via the workpiece exit opening 27.

In the reaction chambers 146, 152, the reactive atmosphere is jetted through orifice arrangements 74, 76, 78, 80 at a temperature below the afore-mentioned critical maximum temperature. Thus, the temperature of the atmosphere prior to being jetted into the reaction chamber is below that at which the atmosphere becomes reactive, and in a specific embodiment of the method of the invention in which the work pieces are carburized, there is no opportunity for particulate carbon to precipitate and be deposited within distribution pipe 34, as precipitation only occurs at temperatures at which the atmosphere is reactive. After the atmosphere enters the reaction chamber 152, the atmosphere is quickly raised to reactive temperatures upon contact with work pieces 144. The exposing of work pieces 144 to a reactive atmosphere at a temperature below the critical maximum temperature is both contrary to the prior art and essential to the method of the invention.

An additional advantage provided by the method of the invention in a specific embodiment incorporating a carbonitriding atmosphere is that the most active gases in the carbonitriding atmosphere are adjacent the workpieces 144 at the time of the disassociation of these carbonitriding gases from their molecular state into an atomic or nascent state. In the case of ammonia, it disassociates into nascent nitrogen at the surface of the hot workpiece 144. Because the disassociation of the active gases occurs at the surface of the workpiece 144, the volume of reactive gas necessary to perform the particular process on a particular workpiece 144 is relatively less than that required by prior art processes. Further, the composition of the case hardened area of the workpiece 144 is relatively easier to control.

TREATMENT OF A SINGLE STACK

The method of treating a single stack of workpieces 144 associated with the specific embodiment illustrated comprises the following steps:

(1) heating the workpieces 144 to a specified temperature;
(2) exposing the workpieces 144 to a first volume of reactive atmosphere;
(3) relieving the workpieces 144 from the first volume of reactive atmosphere;
(4) exposing the workpieces 144 to a second volume of reactive atmosphere; and
(5) relieving the workpieces 144 from the second volume reactive atmosphere.

The workpieces 144 are brought to a specified temperature while in the heat-up portion 148 of the retort 12. The length of time the workpieces 144 spend in and the temperature of the heat-up portion 148 will determine the temperature to which the workpieces 144 are brought. Both the time and temperature can be controlled.

The workpieces 144 are exposed to a first volume of reactive atmosphere while in the first reaction chamber 146. The length of time the workpieces 144 spend in the volume of reactive atmosphere introduced into the first reaction chamber 146 can be controlled by the speed of the retort and the predetermined length of the reaction chamber 146. This exposing step further comprises jetting (at a high velocity) the reactive atmosphere into the stacked workpieces 144 so that the reactive atmosphere fully penetrates the stack and contacts the surface of all the workpieces 144. The reactive atmosphere is jetted via the orifice arrangements 74 and 76.

The workpieces 144 are relieved from the reactive atmosphere in the first reaction chamber 146 be entering a relief portion 150. No fresh reactive gas is introduced into this relief portion of the chamber.

The workpieces 144 then are exposed to a second volume of reactive atmosphere while in the second reaction chamber 152. The length of time the workpieces 144 spend in the volume of reactive atmosphere introduced in the second reaction chamber 152 can be controlled by the same means as with the first reaction chamber, as above mentioned. This second exposing step further comprises jetting (at a high velocity) the reactive atmosphere into the stacked workpieces 144 so that the reactive atmosphere fully penetrates the stack and contacts the surface of all the workpieces 144. The reactive atmosphere is jetted via the orifice arrangements 78 and 80.

The workpieces 144 are relieved from the reactive atmosphere in the second reaction chamber 146 by entering an exit portion 154. No fresh reactive gas is introduced into the exit portion 154.

SIMULTANEOUS TREATMENT OF A PLURALITY OF STACKS OF WORKPIECES

FIG. 1 illustrates five different stacks of workpieces **144*a*, 144*b*, 144*c*, 144*d* and 144*e* at five different locations within the retort 12. Applicant's invention provides for the simultaneous delivery of these different treating steps to these different groups of stack workpieces 144**. The method of simultaneous treatment as a continuous process comprises the steps of simultaneously:

(1) heating a first stack of workpieces **144*a*** to a specified temperature;
(2) exposing a second stack of workpieces **144*b*** to a first volume of reactive atmosphere;
(3) relieving a third stack of workpieces **144*c*** from the first volume of reactive atmosphere;
(4) exposing a fourth stack of workpieces **144*d*** to a second volume of reactive atmosphere;
(5) relieving a fifth stack of workpieces **144*e*** from the reactive atmosphere, and
(6) continuously moving said stacks through the retort 12.

The second stack of workpieces **144*b* are simultaneously exposed to a first volume of reactive atmosphere while in the first reaction chamber 146. The length of time the second stack of workpieces 144*b* spend in and the volume of reactive atmosphere introduced into the first reaction chamber 146 can be controlled. This exposing step further comprises jetting (at a high velocity) the reactive atmosphere into the second stack of workpieces 144*b* so that the reactive atmosphere fully penetrates the stack and contacts the surface of all the workpieces 144*b***.

The third stack of workpieces **144*c* are simultaneously relieved from the reactive atmosphere in the first reaction chamber 146 by entering a relief portion 150. There is little reactive atmosphere contained within the relief portion 150**.

The fourth stack of workpieces **144*d* are simultaneously exposed to a second volume of reactive atmosphere while in the second reaction chamber 152. The length of time the workpieces 144*d* spend in and the volume of reactive atmosphere introduced in the second reaction chamber 152 can be controlled. This second exposing step further comprises jetting (at a high velocity) the reactive atmosphere into the stacked workpieces 144*d* so that the reactive atmosphere fully penetrates the stack and contacts the surface of all the workpieces 144*d***.

The fifth stack of workpieces **144*e* are relieved from the reactive atmosphere in the second reaction chamber 146 by entering an exit portion 154. There is very little or no reactive atmosphere contained within the exit portion 154**.

The "control" of the length of time the workpieces 144 in a reaction chamber of retort 12 is accomplished by predetermining the length of the reaction chamber and controlling net forward the speed of the retort 12.

The "control" of the volume of reactive atmosphere introduced into the reaction chambers is by conventional gas flow controls (not shown).

Each of the aforementioned "exposing" steps include the steps of (a) introducing the atmosphere into the reaction chamber at a temperature below the critical maximum temperature, (b) heating the atmosphere within the reaction chamber to reaction temperatures (temperatures above the critical maximum temperature) by exposing the atmosphere to the relatively hotter workpieces, and (c) reacting the atmosphere with the workpieces.

Each of the aforementioned "heating" and/or relieving steps preceeding a "exposing" step include heating the workpieces to a temperature sufficiently in excess of the critical maximum temperature for the workpieces to hold both the workpieces and the atmosphere at a temperature in excess of the critical maximum temperature during the next to occur "exposing" step.

As above-mentioned the introduction of a reactive atmosphere to a retort or furnace at temperatures below the critical maximum temperature is both essential to the method of the invention and is against the current practice of heat treating. Further, in a specific embodiment where the workpieces are to be carbonitrided to a "case depth" of 0.003–0.006 with a depth of clear martensite of 0.002 inches minimum, the heating of the atmosphere to temperatures above the critical maximum temperature by the workpieces is deemed essential. It has been found that such a specification cannot be met using prior art methods in which the atmosphere is introduced at temperatures above the critical maximum temperature.

Thus, it can be seen that the invention provides a new and improved apparatus and method for heat treating workpieces. Both the apparatus and invention provide for the introduction of a selected volume of reactive atmosphere which approximates the theoretical volume. Consequently, gross excess volumes of reactive atmosphere are not introduced into the reaction chamber and the invention provides an apparatus and method that are not wasteful of reactive atmosphere.

It can also be seen that the invention provides apparatus and method for heat treating workpieces that facilitates the exposure of the workpieces to the reactive atmosphere by ways other than mechanical jostling, including the forceful introduction of the reactive atmosphere directly into the workpieces within the reaction chambers.

It can also be seen that the invention provides an apparatus for heat treating workpieces having a treating chamber divided into a plurality of atmospherically isolated reaction chambers. The invention also provides a method for heat treating workpieces including the introduction and maintenance of a reactive atmosphere into relatively segregated reaction chambers.

While there have been described above the principals of this invention in connection with specific apparatus, it is to be clearly understood that this description is made only by way of example and not as a limitation to the scope of the invention.

What is claimed is:

1. An apparatus for metallurgically heat treating workpieces comprising a rotatable retort having an elongated treating chamber with an entrance and an exit, a workpiece conveyor secured within said treating chamber whereby said workpieces are moved along said treating chamber from said entrance to said exit upon the rotation of said retort, a plurality of partitions within said treating chamber, said partitions cooperating with said conveyor and said treating chamber to divide said treating chamber into a plurality of distinct atmospherically isolated chambers and to allow for the movement of said workpieces into and out of said chambers, and a reactive gas distributor within said treating chamber, said gas distributor being operatively adapted to be connected to a reactive gas source and having gas outlets in selected ones of said chambers.

2. The apparatus of claim 1 wherein said reactive gas distributor includes a pipe passing through each of said reaction chambers with at least one of said gas outlets being contained in a portion of said pipe passing through each of said selected ones of said reaction chambers.

3. The apparatus of claim 2 wherein each of said gas outlets includes at least one pair of oppositely disposed apertures contained in said pipe, said pair of apertures being positioned 90° apart.

4. The apparatus of claim 1 wherein said treating chamber includes opposite ends, said entrance is adjacent one of said ends and said exit is adjacent the other of said ends, an initial heat up chamber between said entrance and one of said selected chambers, said initial heat-up chamber being essentially free of said reactive atmosphere.

5. The apparatus of claim 4 further including means for selecting the time the workpieces remain in said initial heat-up chamber.

6. The apparatus of claim 4 further including an exit chamber between said exit and said chambers, said exit chamber being essentially free of said reactive atmosphere.

7. The apparatus of claim 1 wherein two of said selected chambers are separated by a relief chamber, said relief chamber being essentially free of said reactive atmosphere.

8. The apparatus of claim 1 further including means for selecting the time the workpieces remain in said reaction chambers.

9. The apparatus of claim 1 further comprising means for rotating said treating chamber and workpiece conveyor.

10. An apparatus for metallurgically heat treating workpieces comprising a rotatable retort having an elongated treating chamber therein, a helical member having a centrally located elongated passageway therein secured to said retort within said treating chamber, said helical member extending inwardly of said retort toward said passageway, a gas distributor being within said passageway, a plurality of partitions closing said passageway at selected positions thereby defining with said treating chamber and said helical member a plurality of distinct spaced-apart atmospherically isolated chambers within said treating chamber, and means including said gas distributor for jetting a reactive atmosphere into said workpieces within selected ones of said chambers.

11. The apparatus of claim 10 wherein said jetting means includes at least one gas outlet, said gas outlet including two pairs of opposite orifices positioned 90° apart whereby at least one of said orifices is aimed at said workpieces.

12. The apparatus of claim 10 wherein each of said partitions includes a cylindrical pipe support having opposite ends, an impedance disc being affixed within said pipe support adjacent each of said opposite ends thereof, said impedance discs having a diameter only slightly smaller than that of said passageway whereby said impedance discs impedes gas flowing in said passageway from moving there past.

13. The apparatus of claim 12 wherein said gas distributor includes a distribution pipe, and one of said chambers is contained between adjacent ones of said partitions affixed along the length of said distribution pipe.

14. The apparatus of claim 13 wherein said treating chamber includes opposite ends, an entrance being contained in one of said ends and an exit being contained in other of said ends, a heat-up portion being contained between said entrance and a first one of said chambers, and an exit portion being contained between said exit and a last one of said chambers.

15. The apparatus of claim 10 wherein a relief portion is contained between adjacent ones of said selected chambers.

16. The apparatus of claim 10 wherein said jetting means jets a selected volume of reactive atmosphere into a stack of workpieces in said selected chambers.

17. An apparatus for metallurgically heat treating workpieces comprising a rotatable retort having an elongated treating chamber therein, a helical member having a centrally located elongated passageway therein secured to said retort within said treating chamber, said helical member extending inwardly of said chamber toward said passageway, a gas distribution pipe positioned within said passageway and extending the entire length of said helical member, a plurality of spaced-apart gas distribution pipe supports connected to said pipe, said pipe supports being within the said passageway and supported by said helical member, said pipe supports positioning said pipe generally coaxial of said treating chamber and said helical member whereby fatigue stresses exerted on said distribution pipe are reduced, said pipe supports and treating chamber and helical chamber defining a plurality of spaced-apart atmospherically isolated chambers in said treating chamber.

18. The apparatus of claim 17 wherein each of said pipe supports includes a cylindrical housing having opposite ends, one gas impedance disc having an aperture contained therein is affixed to one of said housing ends, an other gas impedance disc having an aperture contained therein is affixed to the other of said housing ends, said distribution pipe passing through said apertures, said one disc being affixed to said distribution pipe, said other disc being unattached to said pipe whereby said other gas impedance disc damps the arcing of and allows for expansion and contraction of said gas distribution pipe.

19. The apparatus of claim 17 wherein said pipe supports are free to move axially of said treating chamber within said passageway to accomodate the expansion and contraction of said distribution pipe during use.

20. An apparatus for metallurgically heat treating workpieces comprising a rotatable retort having an elongated treating chamber with an entrance and an exit, a workpiece conveyor secured within said treating chamber whereby said workpieces are moved along said treating chamber from said entrance to said exit upon the rotation of said retort, a plurality of partitions within said treating chamber, said partitions cooperating with said conveyor and said treating chamber to divide said treating chamber into a plurality of distinct atmospherically isolated chambers and to allow for the movement of said workpieces into and out of said chambers, and a plurality of reactive gas distributors, and means including said gas distributors for jetting a reactive atmosphere into selected ones of said chambers.

21. The apparatus of claim 20 wherein said plurality of gas distributors comprises a plurality of coaxial distribution pipes, each of said pipes being operatively connected to a said selected reactive gas source.

* * * * *